US010631629B2

(12) United States Patent
Hung

(10) Patent No.: US 10,631,629 B2
(45) Date of Patent: Apr. 28, 2020

(54) FOLDING TABLE

(71) Applicant: MODERNSOLID INDUSTRIAL CO., LTD., Taichung (TW)

(72) Inventor: Chin-Jui Hung, Taichung (TW)

(73) Assignee: Modernsolid Industrial Co., Ltd., Taichung (TW)

( * ) Notice: Subject to any disclaimer, the term of this patent is extended or adjusted under 35 U.S.C. 154(b) by 163 days.

(21) Appl. No.: 15/938,805

(22) Filed: Mar. 28, 2018

(65) Prior Publication Data

US 2018/0338605 A1 Nov. 29, 2018

(30) Foreign Application Priority Data

May 26, 2017 (TW) ..... 106207558 U

(51) Int. Cl.

| | |
|---|---|
| ***A47B 3/00*** | (2006.01) |
| ***A47B 3/083*** | (2006.01) |
| ***A47B 3/08*** | (2006.01) |
| ***A47B 7/02*** | (2006.01) |
| *A47B 3/06* | (2006.01) |
| *A47B 9/06* | (2006.01) |

(52) U.S. Cl.

CPC ..... *A47B 3/083* (2013.01); *A47B 3/0815* (2013.01); *A47B 7/02* (2013.01); *A47B 3/06* (2013.01); *A47B 3/0818* (2013.01); *A47B 9/06* (2013.01); *A47B 2003/0806* (2013.01); *A47B 2200/0025* (2013.01)

(58) Field of Classification Search

CPC ..... A47B 3/08; A47B 3/0809; A47B 3/0815; A47B 3/0818; A47B 9/00; A47B 9/06

See application file for complete search history.

(56) References Cited

U.S. PATENT DOCUMENTS

| | | | | | |
|---|---|---|---|---|---|
| 3,707,862 | A * | 1/1973 | Pastva, Jr. | E05C 1/145 | 70/150 |
| 3,796,169 | A * | 3/1974 | Bales | A47B 3/0815 | 108/116 |
| 4,986,195 | A * | 1/1991 | Diffrient | A47B 3/08 | 108/1 |
| 5,666,888 | A * | 9/1997 | Dame | A47B 9/06 | 108/147.21 |
| 6,092,771 | A * | 7/2000 | Fich | A47B 9/06 | 248/188.5 |
| 6,296,312 | B1 * | 10/2001 | Congleton | A47C 1/03 | 297/411.35 |

(Continued)

*Primary Examiner* — Matthew W Ing

(74) *Attorney, Agent, or Firm* — Michael Best & Friedrich LLP

(57) ABSTRACT

A folding table includes a support stand, a fold mechanism, and a table top. The support stand includes a top seat having a first engaging portion. The fold mechanism includes a fold seat pivoted to the top seat, a resilient unit, and an operating member having a second engaging portion. When the table top is at an unfolded position, the operating member is operable from a lock state, where the second engaging portion of the operating member is biased by the resilient unit to engage the first engaging portion of the top seat, to an unlock state, where the second engaging portion is disengaged from the first engaging portion against a resilient force of the resilient unit, thereby permitting pivot movement of the table top to the folded position.

20 Claims, 11 Drawing Sheets

(56) References Cited

U.S. PATENT DOCUMENTS

| | | | | |
|---|---|---|---|---|
| 6,390,424 | B1 * | 5/2002 | Kidushim | A45D 20/12 248/122.1 |
| 6,845,723 | B2 * | 1/2005 | Kottman | A47B 3/00 108/115 |
| 10,051,960 | B1 * | 8/2018 | Siebert | A47B 85/04 |
| 2005/0235886 | A1 * | 10/2005 | Koning | A47B 3/0818 108/132 |
| 2009/0205541 | A1 * | 8/2009 | Nyenhuis | A47B 5/00 108/124 |
| 2011/0290160 | A1 * | 12/2011 | Williams | A47B 3/00 108/124 |
| 2013/0284077 | A1 * | 10/2013 | Copeland | A47B 3/00 108/117 |
| 2016/0061241 | A1 * | 3/2016 | Hansen | A47B 9/06 108/147.21 |
| 2018/0228279 | A1 * | 8/2018 | Guzman | A47B 9/14 |

* cited by examiner

FOLDING TABLE

CROSS-REFERENCE TO RELATED APPLICATION

This application claims priority of Taiwanese Utility Model Patent Application No. 106207558, filed on May 26, 2017.

FIELD

The disclosure relates to a table, and more particularly to a folding table.

BACKGROUND

Referring to FIG. 1, a conventional folding table 1 includes a support stand 11, a table top 12, and a fold mechanism 13. The support stand 11 includes a base 111 and a support post 112 extending upward from the base 111. The table top 12 is disposed adjacent to a top portion of the support post 112. The fold mechanism 13 includes a rod member 131, a positioning plate 132 that is semi-circular in shape, and a lock member 133. The rod member 131 is mounted to a bottom side of the table top 12 and has one end pivoted to the top portion of the support post 112. The positioning plate 132 is connected to the rod member 131, is disposed adjacent to the support post 112, and has a plurality of angularly spaced-apart positioning holes 134. The lock member 133 has a rod-shaped body 135, an external threaded portion 136 formed on the rod-shaped body 135, and a triangular head 137 connected to one end of the rod-shaped body 135. The table top 12 can be positioned relative to the support post 112 by rotating the triangular head 137 to drive the rod-shaped body 135 of the lock member 133 to extend through the support post 112 with the external threaded portion 136 threadedly engaging an internal threaded portion of the support post 112, and then extend through one of the positioning holes 134 of the positioning plate 132.

Even though the table top 12 can be positioned relative to the support post 112 to a folded position or an unfolded position by having the lock member 133 extending threadedly through the support post 112 and through a selected one of the positioning holes 134, operation of threaded engagement or disengagement between the internal threaded portion of the support post 112 and the external threaded portion 136 of the lock member 133 is not only time-consuming but also inconvenient for an operator. Thus there is room for improving the conventional folding table 1.

SUMMARY

Therefore, an object of the disclosure is to provide a folding table that can alleviate at least one of the drawbacks of the prior art.

According to the disclosure, the folding table includes a support stand, a fold mechanism, and a table top.

The support stand includes a base, a supporter that extends upward from the base, and a top seat that is disposed on a top end portion of the supporter and that has a pivot portion and a first engaging portion.

The fold mechanism includes a fold seat, an operating member, and a resilient unit. The fold seat is pivoted to the pivot portion of the top seat and is formed with a receiving space. The operating member is movably connected to the fold seat, and has a second engaging portion engageable with the first engaging portion, and an abutment portion located in the receiving space. The resilient unit is disposed in the receiving space, and is connected to the abutment portion of the operating member.

The table top is disposed adjacent to the top seat of the support stand, is connected to the fold seat, and is pivotable relative to the support stand between an unfolded position to be disposed above a top end of the support stand, and a folded position to be disposed at a lateral side of the support stand.

When the table top is at the unfolded position, the operating member is operable from a lock state, where the second engaging portion of the operating member is biased by the resilient unit to engage the first engaging portion of the top seat, to an unlock state, where the second engaging portion of the operating member is disengaged from the first engaging portion of the top seat against a resilient force of the resilient unit, thereby permitting pivot movement of the table top to the folded position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
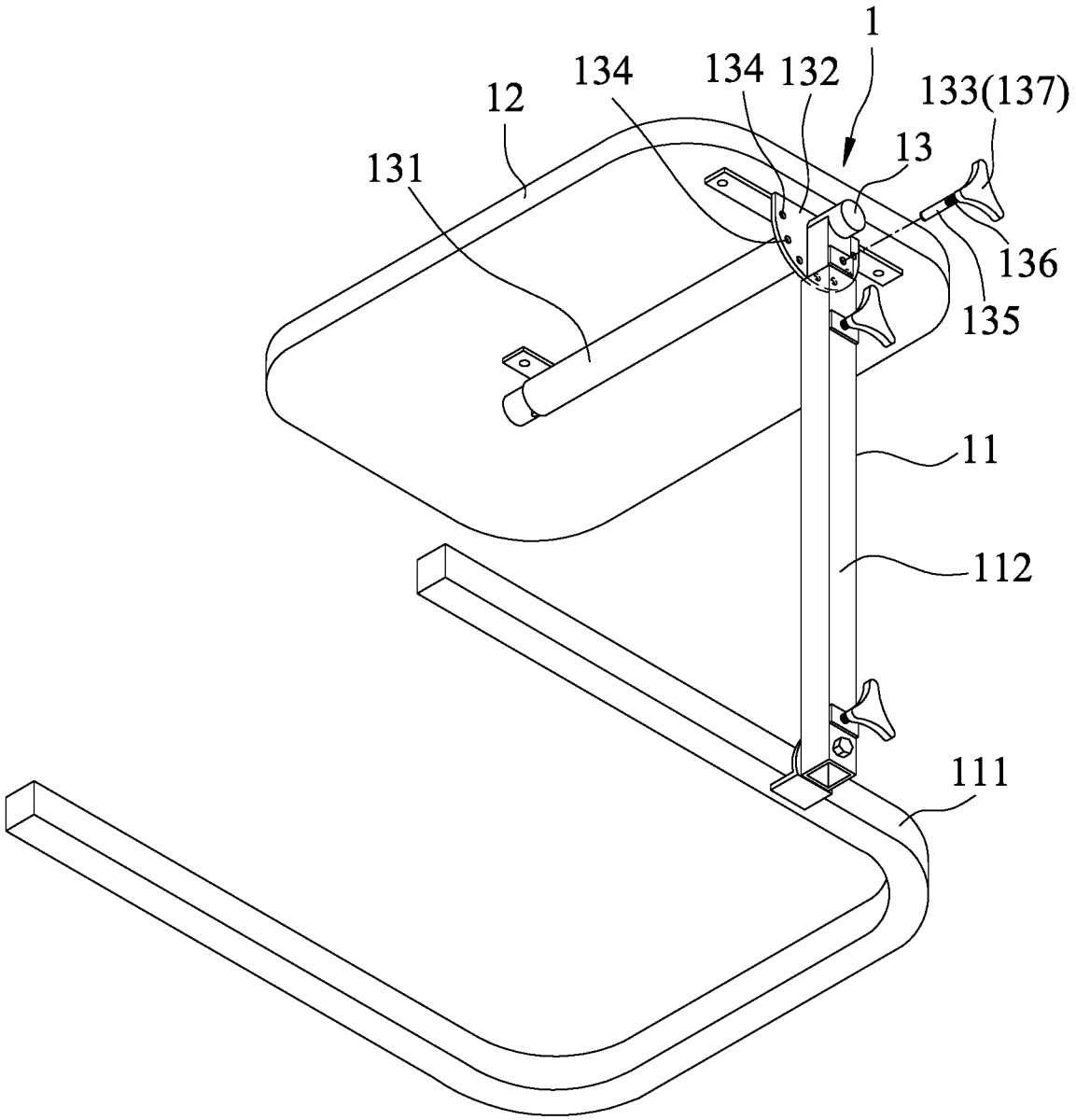
FIG.1 PRIOR ART
FIG. 1 is a perspective view of a conventional folding table.
Figure 2:
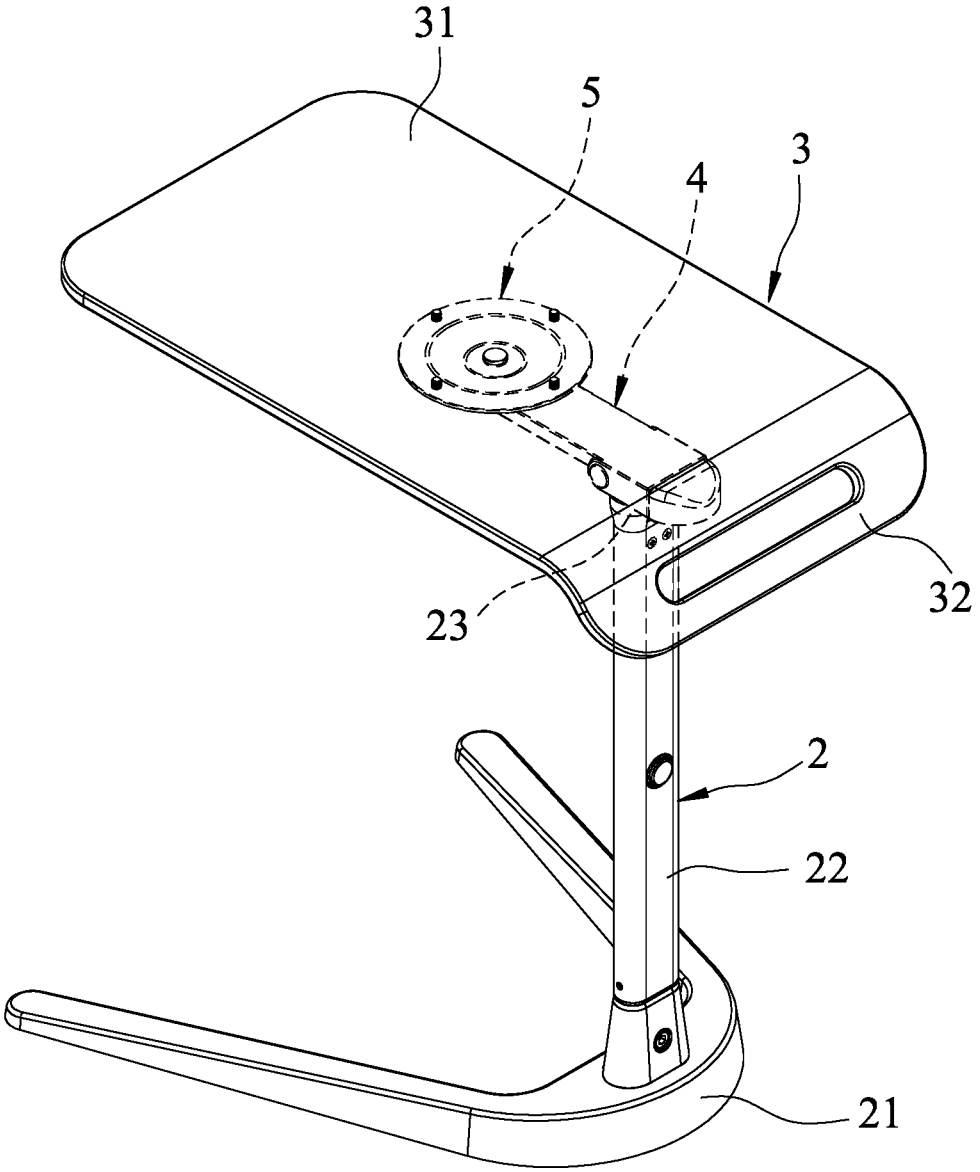
FIG. 2 is a perspective view illustrating an embodiment of a folding table according to the disclosure.
Figure 3:
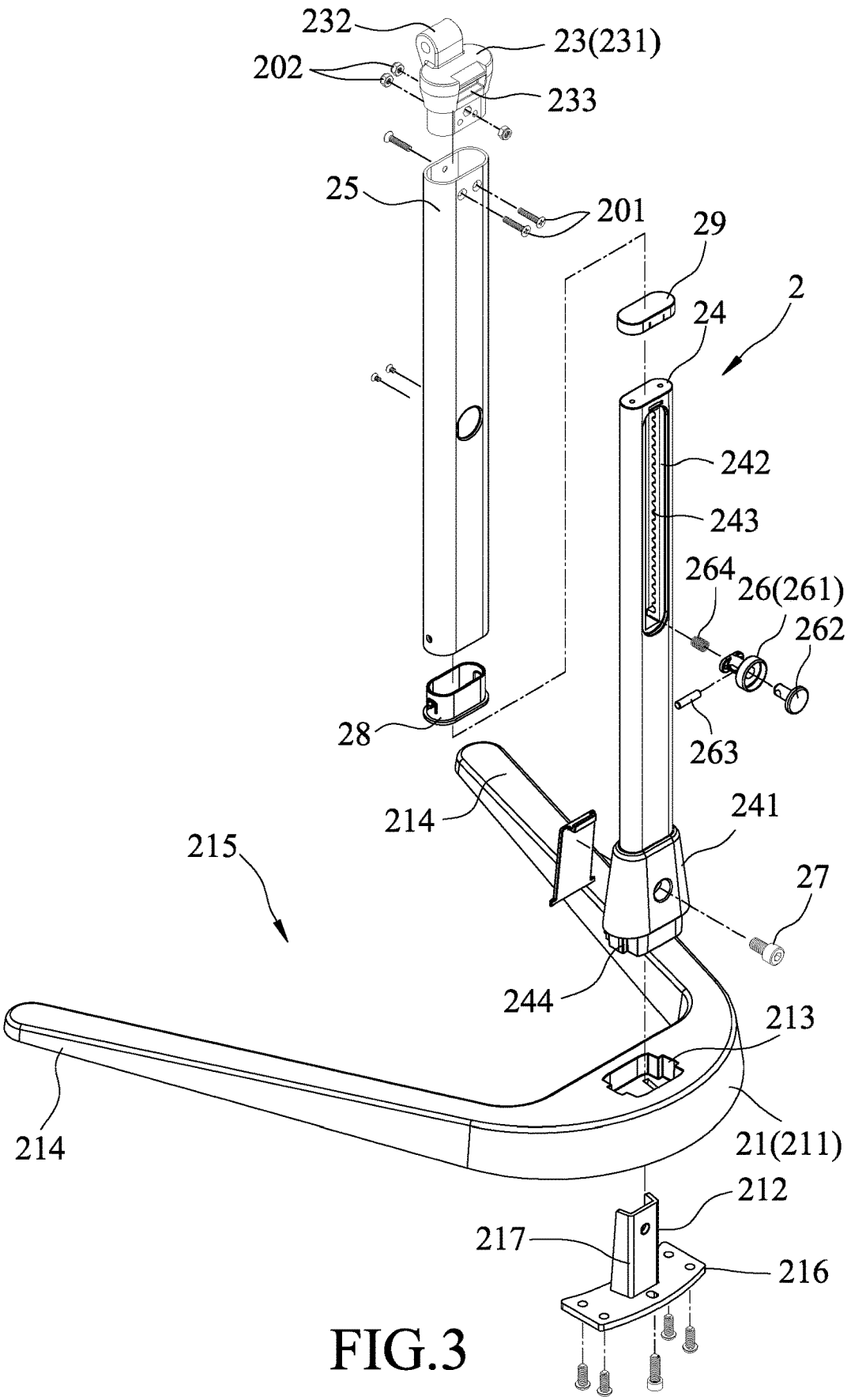
FIG. 3 is a exploded perspective view of a support stand of the embodiment.
Figure 4:
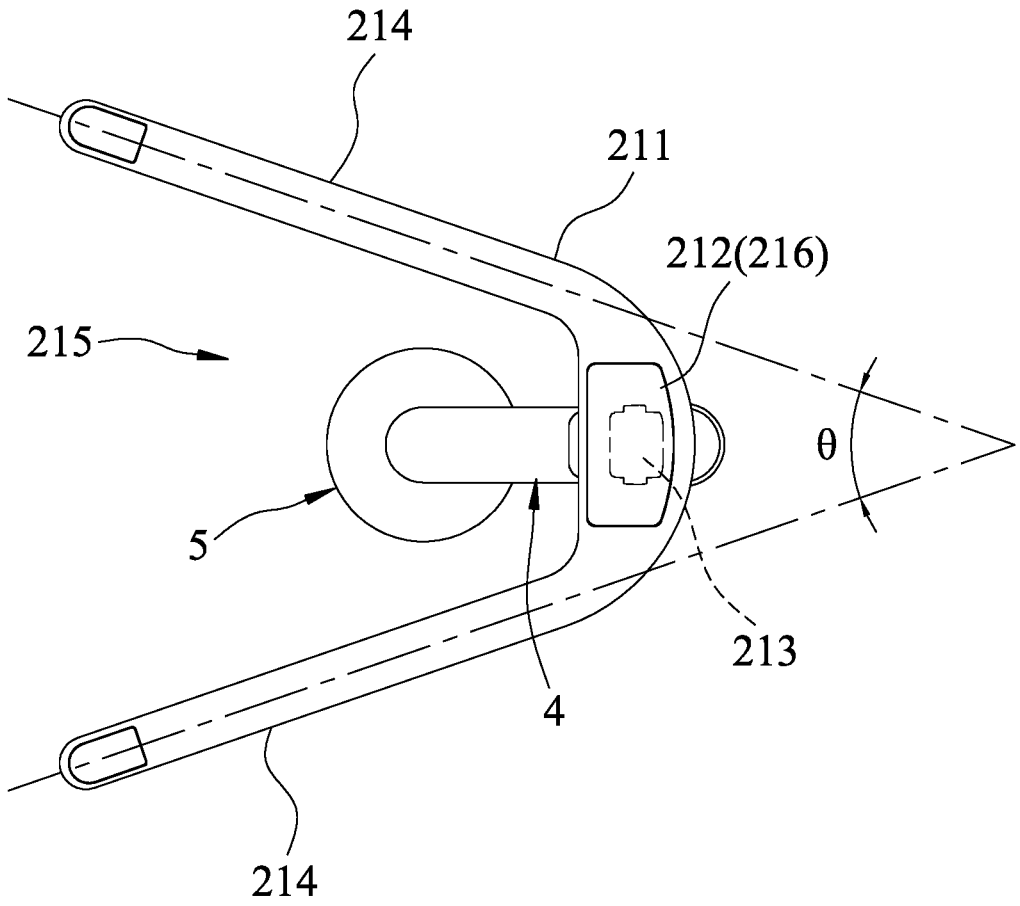
FIG. 4 is a fragmentary bottom view of the embodiment.

Referring to FIGS. 2 to 4, an embodiment of a folding table according to the disclosure includes a support stand 2, a table top 3, a fold mechanism 4, and a tray 5.

The support stand 2 includes a base 21, a supporter 22 that extends upward from the base 21, and a top seat 23 that is disposed on a top end portion of the supporter 22.

The base 21 has a substantially U-shaped base body 211 and a fixing member 212. The base body 211 is formed with a mounting groove 213 that has a non-circular cross section. In this embodiment, the mounting groove 213 is substantially cross-shaped. The base body 211 has two leg end portions 214 that are not parallel to each other, and that cooperatively form an angle (θ) of less than 90 degrees. The base body 211 defines an opening 215 between the leg end portions 214. In this embodiment, each of the leg end portions 214 is wedge-shaped. The fixing member 212 is made of metal, and has a base plate 216 that is located at a bottom side of the base body 211, and a fixing piece 217 that protrudes from the base plate 216. The base plate 216 and the fixing piece 217 may be welded together, or may be molded as one piece.

Figure 5:
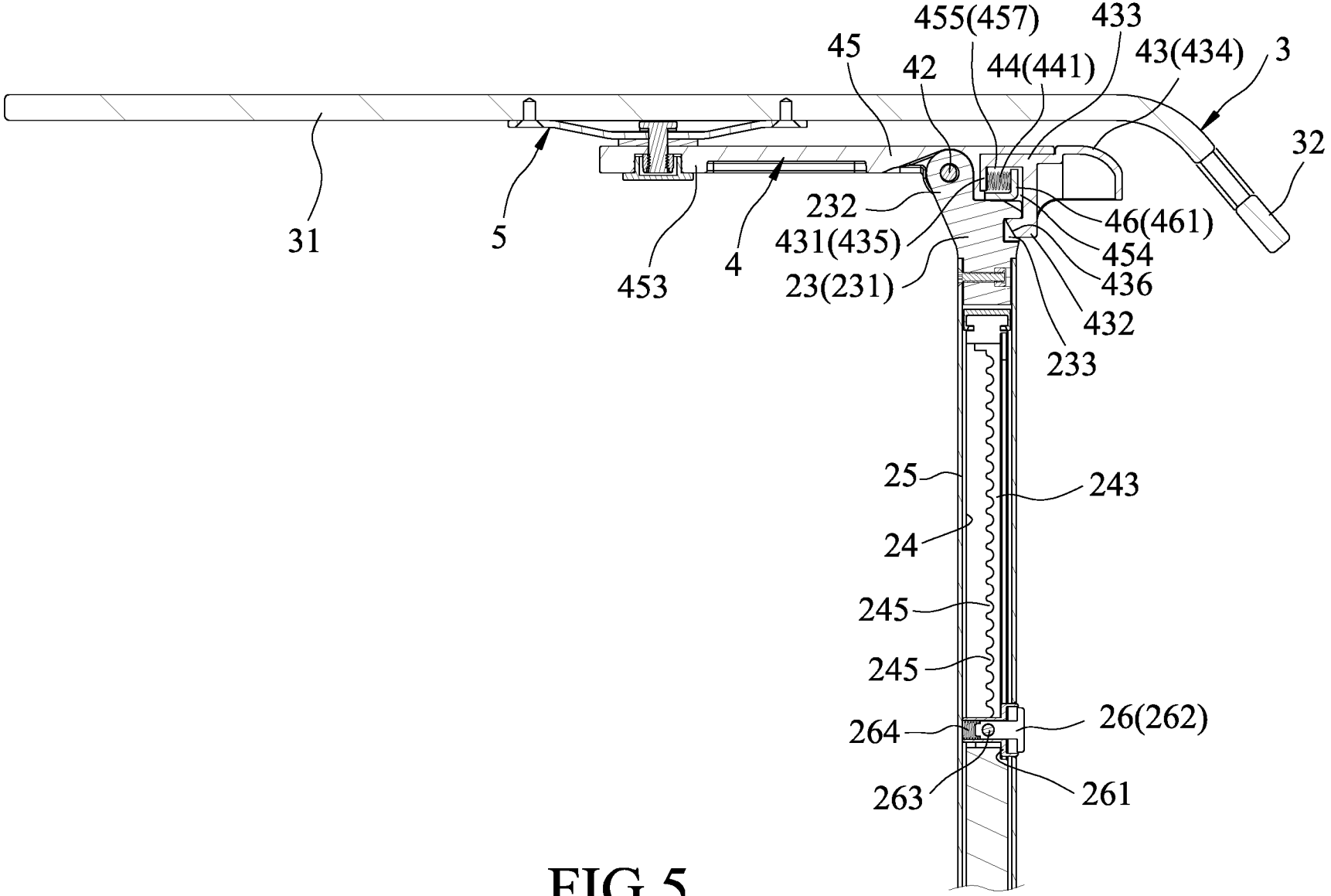
FIG. 5 is a fragmentary sectional view of the embodiment, illustrating a table top at an unfolded position and an operating member in a lock state.

Referring to FIGS. 2, 3, and 5, the supporter 22 has an upright post 24, a sleeve member 25 slidably sleeved on the upright post 24, and a positioning mechanism 26 connected to the sleeve member 25 and disposed for positioning the sleeve member 25 relative to the upright post 24.

The upright post 24 has a hollow coupling end portion 241, an extension slot 242, and a toothed rack portion 243. The coupling end portion 241 is connected non-rotatably to the base 21, and has a main body segment that gradually increases in cross section toward the base 21, and a protrusion segment 244 that protrudes from the main body segment and that has a non-circular cross section corresponding in shape to the mounting groove 213. After the protrusion segment 244 is fittingly inserted into the mounting groove 213, the fixing piece 217 of the fixing member 212 can extend into the coupling end portion 241 of the supporter 22 from the bottom side of the base body 211 through the mounting groove 213 to be securely coupled to the coupling end portion 241 via a lock member 27. As such, the upright post 24 is stably coupled to the base 21. The extension slot 242 is located at a top portion of the upright post 24, is elongated in a lengthwise direction of the upright post 24, and extends through opposite lateral sides of the upright post 24. The toothed rack portion 243 is disposed in the extension slot 242 and has a plurality of spaced-apart tooth grooves 245.

The supporter 22 is provided with a bottom bushing 28 that is located adjacent to a bottom portion of the upright post 24, and that is disposed between the upright post 24 and the sleeve member 25 so as to prevent friction contact therebetween. In this embodiment, the supporter 22 is further provided with a top bushing 29 located adjacent to the top portion of the upright post 24 to further prevent friction contact between the upright post 24 and the sleeve member 25.

Figure 6:
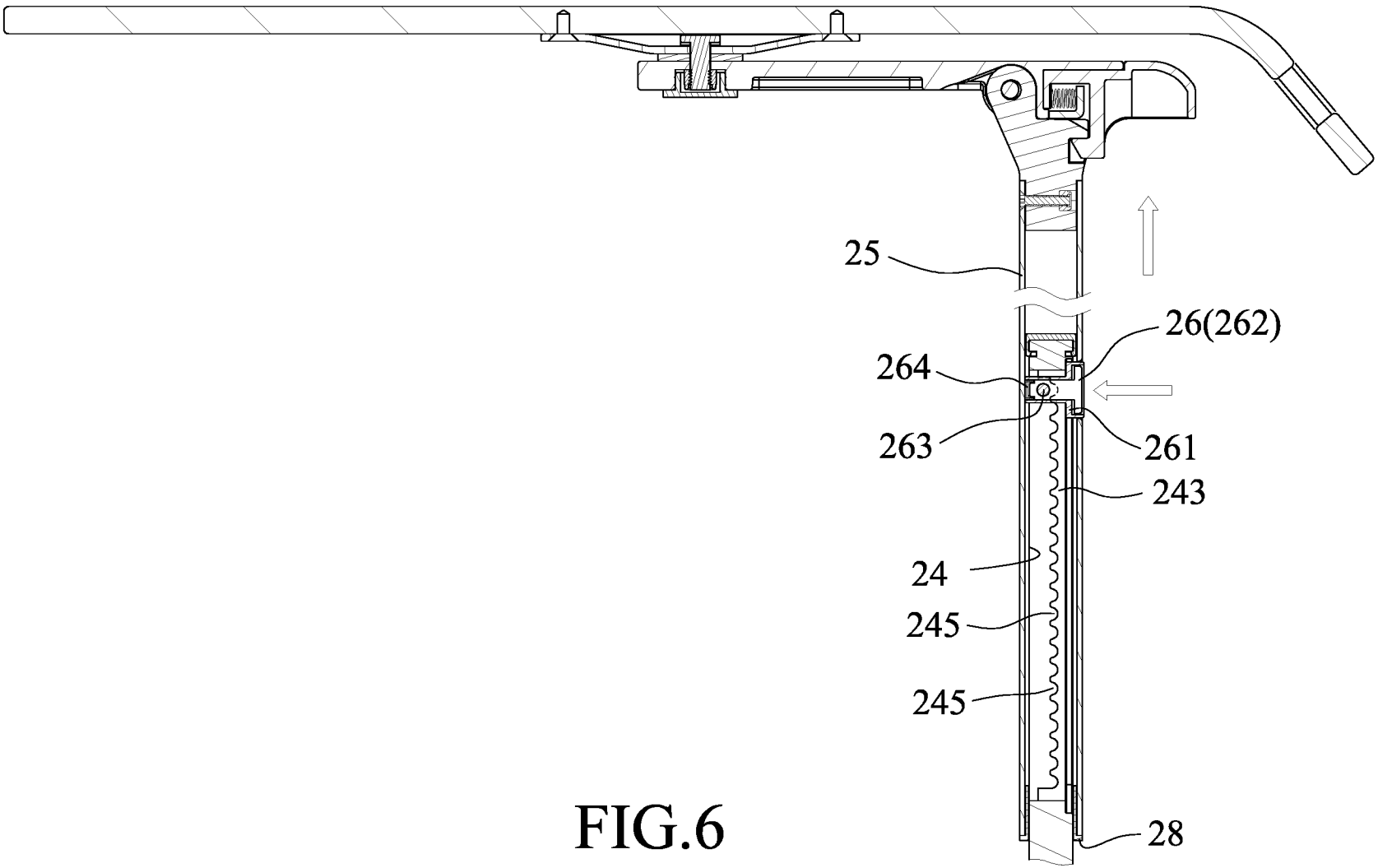
FIG. 6 is a fragmentary sectional view illustrating a press member being pressed for allowing length adjustment of the support stand.

Referring to FIGS. 3, 5, and 6, the positioning mechanism 26 has a positioning seat 261 that is connected to the sleeve member 25, a press member 262 that is disposed on the positioning seat 261 to be connected to the sleeve member 25, a pin 263 that is co-movably connected to the press member 262 and that is located in the extension slot 242, and a resilient component 264 that has two ends respectively abutting against the press member 262 and an inner wall of the sleeve member 25 for biasing the pin 263 to engage one of the tooth grooves 245 to thereby position the sleeve member 25 relative to the upright post 24, as illustrated in FIG. 5. The press member 262 is pressable relative to the sleeve member 25 against a resilient force of the resilient component 264 to disengage the pin 263 from the one of the tooth grooves 245 for allowing movement of the sleeve member 25 relative to the upright post 24, as illustrated in FIG. 6. In this way, the length of the supporter 22 is adjustable to suit the need of a user. In this embodiment, the resilient component 264 is a compression spring.

The top seat 23 has a seat body 231, and a pivot portion 232 and a first engaging portion 233 respectively disposed on opposite sides of the seat body 231. The seat body 231 is inserted into a top portion of the sleeve member 25. The support stand 2 further includes three screws 201 that extend through a side of the sleeve member 25, the seat body 231, and an opposite side of the sleeve member 25 for securely coupling the seat body 231 and the sleeve member 25. The screws 201 are fastened via three screw nuts 202, respectively. More specifically, two of the screws 201 are applied to extend in a direction which is the same as the direction the opening 215 of the base body 211 faces, and the remaining one of the screw 201 is applied to extend in a direction which is opposite to the direction the opening 215 faces.

Figure 7:
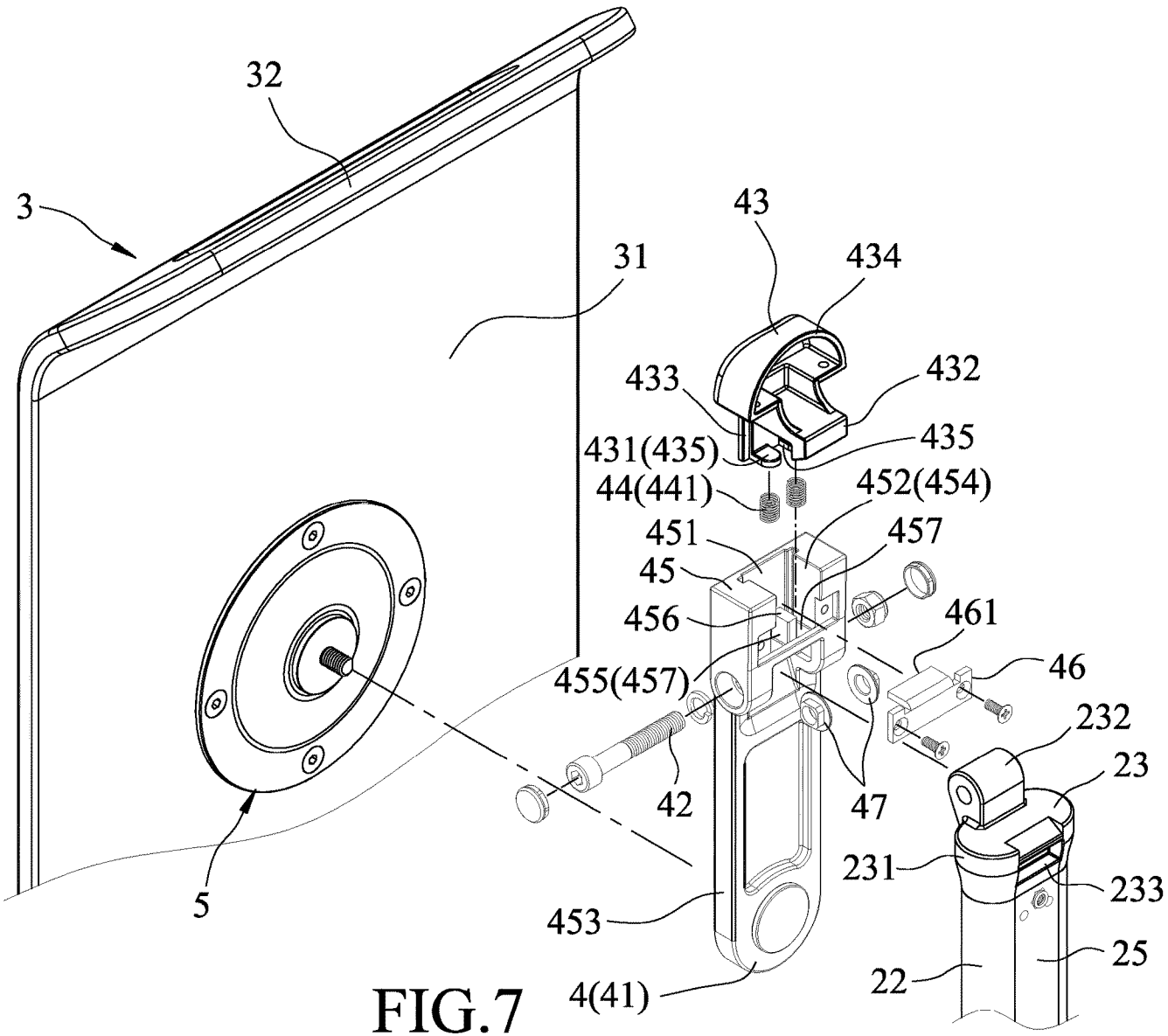
FIG. 7 is a fragmentary partly exploded perspective view of the embodiment.
Figure 8:
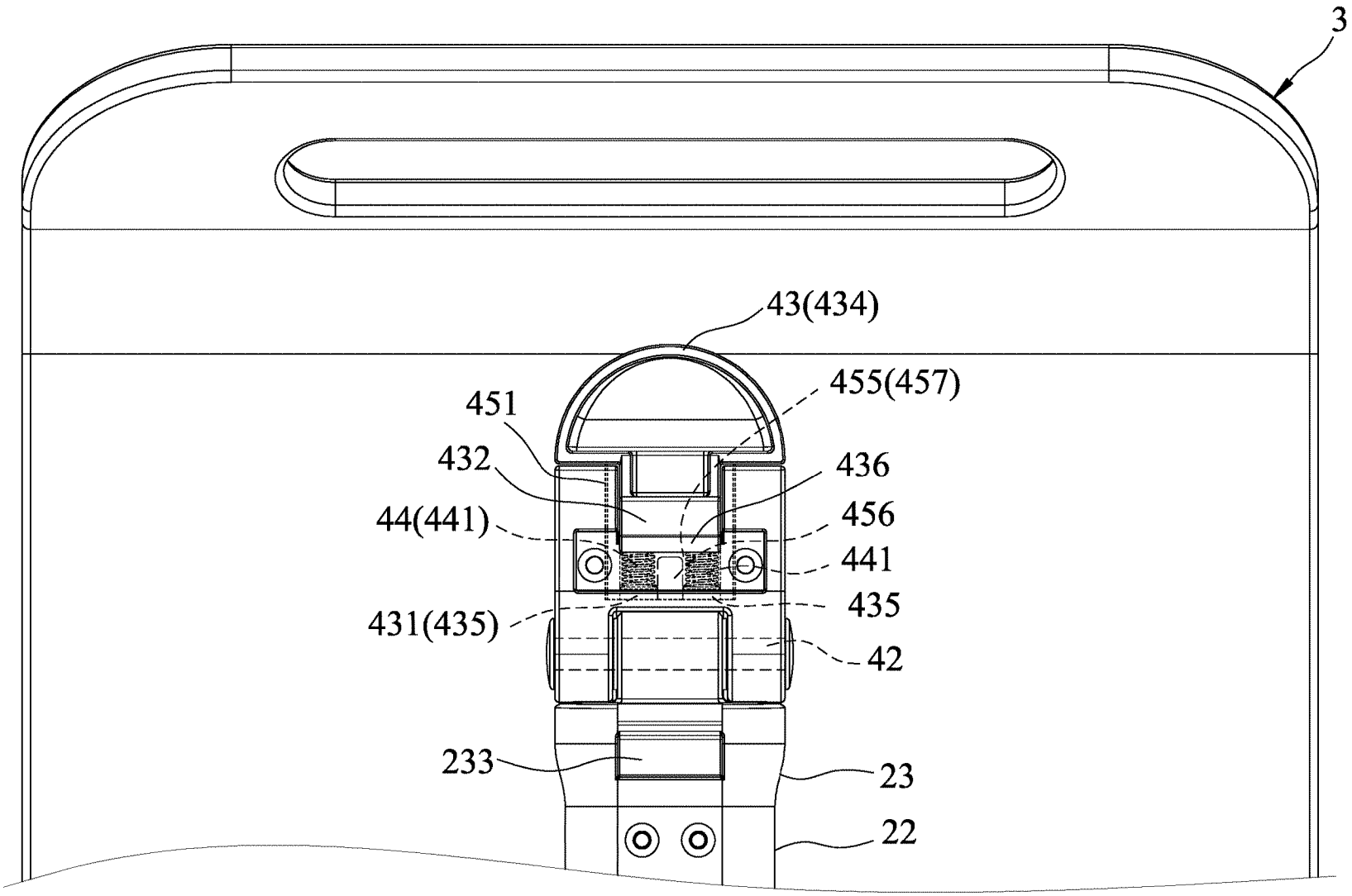
FIG. 8 is a fragmentary side view of the embodiment.

Referring to FIGS. 5, 7, and 8, the fold mechanism 4 includes a fold seat 41, an operating member 43, and a resilient unit 44.

The fold seat 41 includes a main body 45 and a stop member 46. The main body 45 is pivoted to the pivot portion 232 of the top seat 23 via a pivot axle 42, and is formed with a guiding groove 451 which extends substantially parallel to the table top 3, a receiving space 455 which is proximate to the pivot axle 42, and a slide space 454 which is distal from the pivot axle 42. The guiding groove 451, the receiving space 455, and the slide space 454 are in spatial communication with one another. The main body 45 has an extension portion 453 that extends in a direction away from the pivot axle 42, and is connected to the table top 3 through the tray 5. It should be noted that the extension portion 453 of the main body 45 may be indirectly connected to the table top 3 through, for example, the tray 5, or directly connected to the table top 3. The pivot axle 42 extends through the main body 45 of the fold seat 41 and the pivot portion 232 of the top seat 23. The fold mechanism 4 is provided with two axle sleeves 47 that are disposed in the main body 45, and that are sleeved on the pivot axle 42 so as to facilitate rotation of the main body 45 about the pivot axle 42. In this embodiment, the fold seat 41 further has a dividing member 456 that is disposed in the receiving space 455, and that divides the receiving space 455 into two sub space sections 457.

The stop member 46 covers the receiving space 455, and includes a stop plate 461 that extends into the main body 45 of the fold seat 41 to partition the receiving space 455 and the slide space 454. In this embodiment, the stop member 46 is securely fastened onto the main body 45 via screws.

The operating member 43 is movably connected to the fold seat 41, and has a second engaging portion 432 located in the slide space 454 and engageable with the first engaging portion 233, an abutment portion 431 located in the receiving space 455, a connecting body portion 433 being movable along the guiding groove 451 and interconnecting the abutment portion 431 and the second engaging portion 432, and an operating portion 434 disposed on a side of the connecting body portion 433 opposite to the abutment portion 431 for access of a user.

One of the first and second engaging portions 233, 432 is a hook, and the other one of the first and second engaging portions 233, 432 is a groove. In this embodiment, the first engaging portion 233 is a groove that opens toward a side of the top seat 23 opposite to the pivot portion 232, and the second engaging portion 432 is a hook that has a hook end and being formed with an inclined surface 436.

The abutment portion 431 of the operating member 43 includes two abutment pieces 435 that are respectively located in the sub space sections 457.

The resilient unit 44 is disposed in the receiving space 455, and includes two resilient members 441 respectively disposed in the sub space sections 457. Each of the resilient members 441 is connected between the stop plate 461 and a respective one of the abutment pieces 435, so as to bias the operating member 43 toward the pivot axle 42. In this embodiment, each of the resilient members 441 is a compression spring.

The table top 3 is disposed adjacent to the top seat 23 of the support stand 2, is connected to the fold seat 41 of the fold mechanism 4, and is pivotable relative to the supporter 22 of the support stand 2 between an unfolded position to be disposed above a top end of the support stand 2 and be substantially perpendicular to the supporter 22, and a folded position to be disposed at a lateral side of the support stand 2. The table top 3 has a body part 31 connected to the extension portion 453 of the main body 45 of the fold seat 41, and a handle part 32 located adjacent to a side of the body part 31 for operation by a user.

Figure 9:
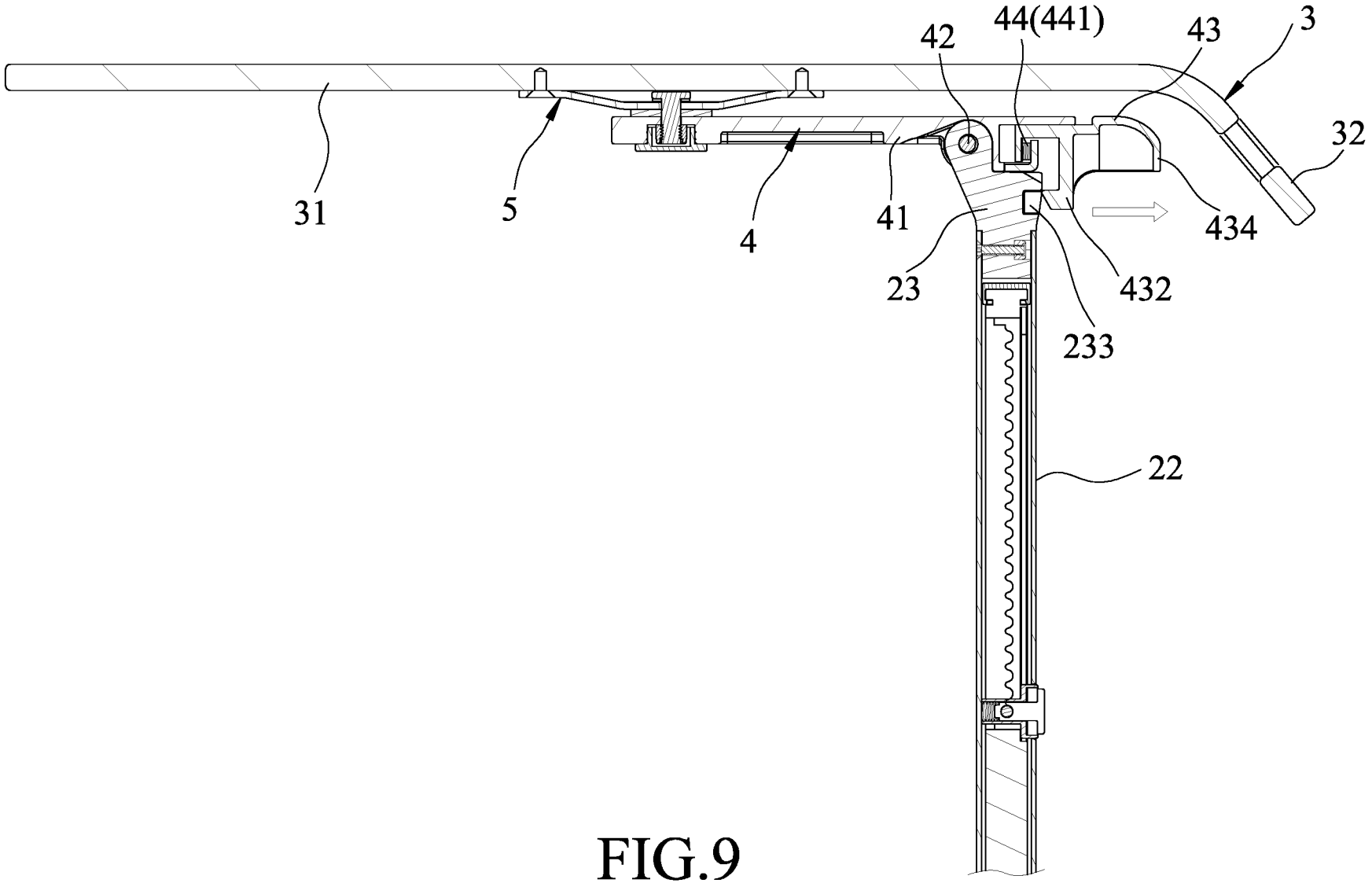
FIG. 9 is a view similar to FIG. 5, but illustrating the operating member being moved to an unlock state.

Referring to FIGS. 5 and 9, when the table top 3 is at the unfolded position, the operating member 43 is operable from a lock state (see FIG. 5), where the second engaging portion 432 of the operating member 43 is biased by the resilient unit 44 to engage the first engaging portion 233 of the top seat 23 to thereby maintain the table top 3 at the unfolded position, to an unlock state (see FIG. 9), where the second engaging portion 432 of the operating member 43 is disengaged from the first engaging portion 233 of the top seat 23 against a resilient force of the resilient unit 44 to thereby permit pivot movement of the table top 3 to the folded position.

Figure 10:
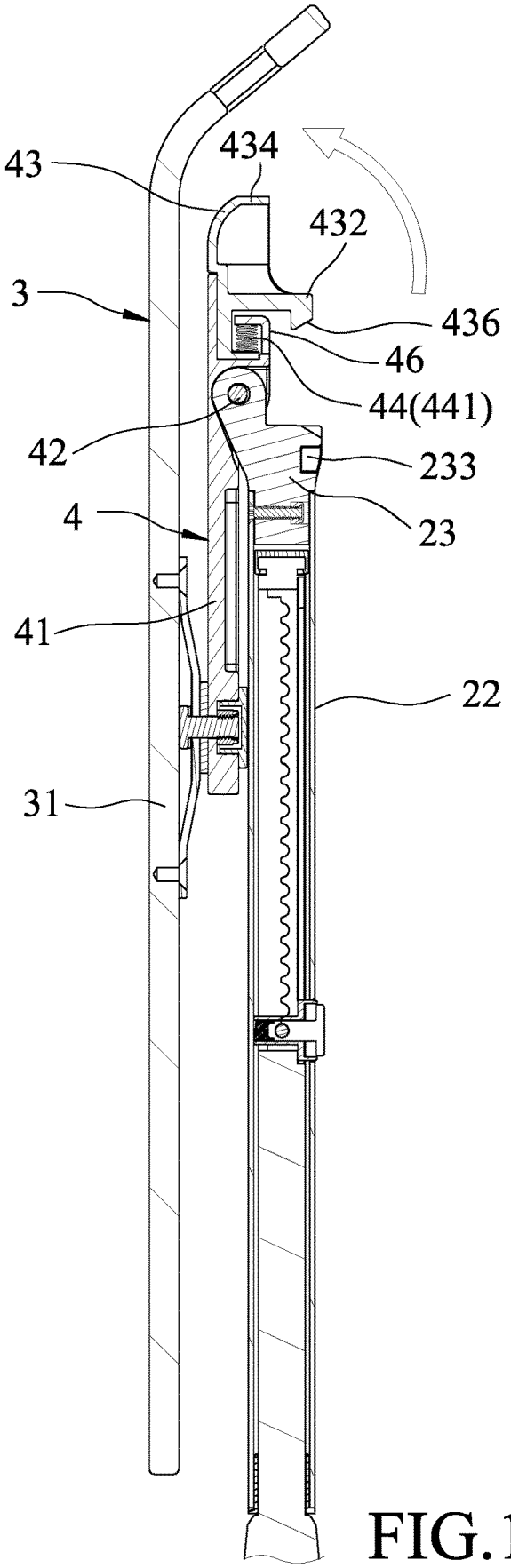
FIG. 10 is a fragmentary schematic sectional view of the embodiment, illustrating the table top at the folded position.

For use, the user can covert the table top 3 from the unfolded position to the folded position by holding the operating portion 434 of the operating member 43 and moving the operating member 43 in a direction away from the pivot axle 42, as indicated by the arrow in FIG. 9, to disengage the second engaging portion 432 from the first engaging portion 233 so as to permit pivot movement of the fold seat 41 relative to the top seat 23. At this time, the user can hold the handle part 32 of the table top 3 to move the table top 3 to the folded position as illustrated in FIG. 10.

Figure 11:
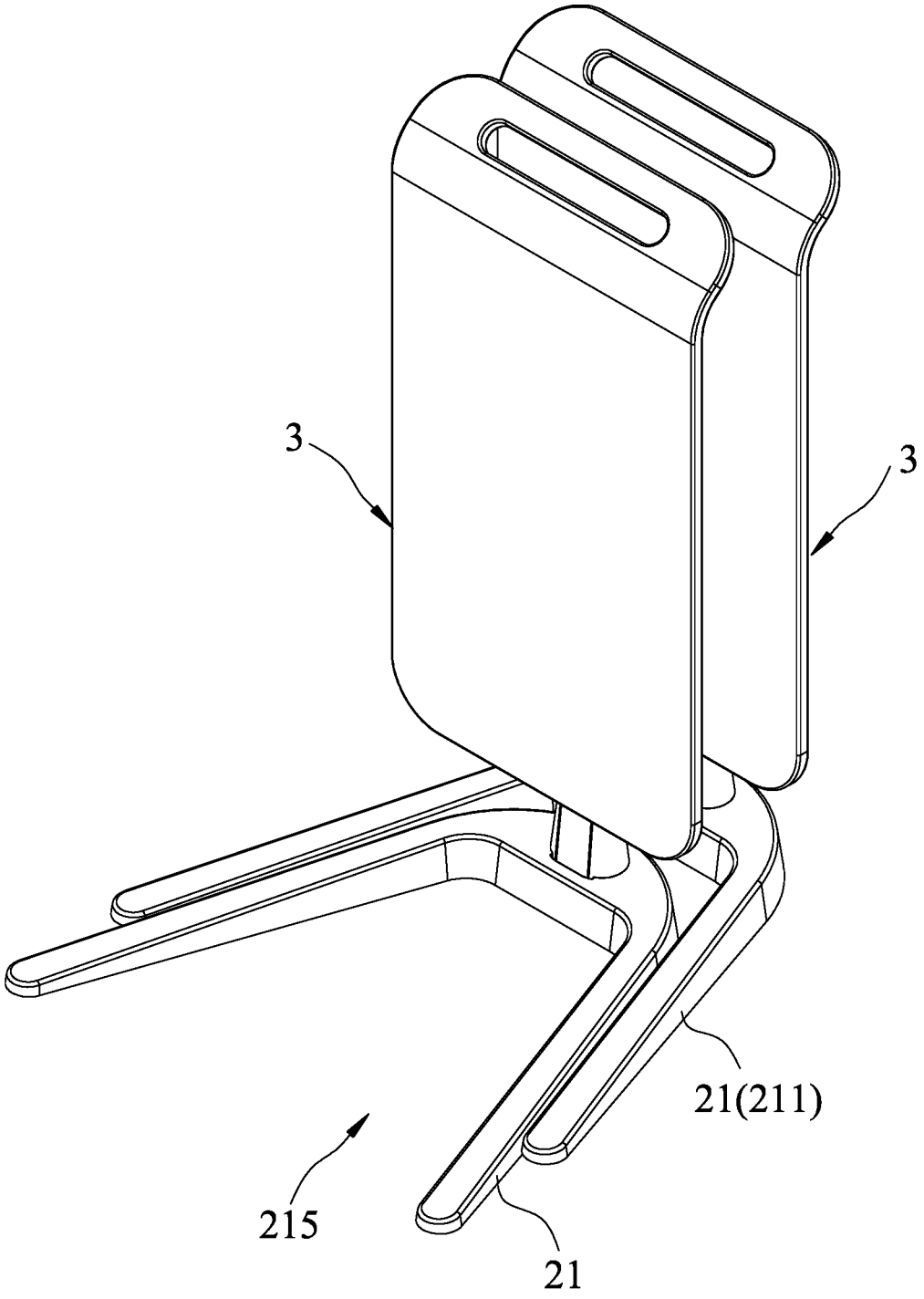
FIG. 11 is a perspective view illustrating two of the folding tables of the embodiment being stacked horizontally with the table tops at the folded position.

Referring back to FIG. 5, the user can convert the table top 3 back to the unfolded position by simply holding the handle part 32 of the table top 3 and moving the table top 3 to the unfolded position. At the moment the table top 3 reaches the unfolded position, the second engaging portion 432 engages the first engaging portion 233 via the resilient force of the resilient members 441 to thereby maintain the table top 3 at the unfolded position. In this way, the table top 3 can be converted between the folded and unfolded positions in a quick and easy manner. In the unfolded position, the table top 3 can be used to place objects thereon. In the folded position, the table top 3 is disposed parallel to the supporter 22 and has a relatively small space occupancy. As shown in FIG. 11, two of the folding tables of this embodiment can be stacked horizontally with the openings 215 of the bases 21 of the support stands 2 facing the same direction. By virtue of the configuration of the base body 211 of the base 21, a plurality of the folding tables can be stored by stacking horizontally, which facilitates storage and has a relatively small space occupancy.

In summary, the folding table of the disclosure has the following advantages:

1. The table top 3 can be converted from the folded position to the unfolded position simply by pivot movement of the table top 3, and can be converted back to the folded position by operating the operating member 43 to the unlocked state to permit pivot movement of the table top 3. Therefore, the table top 3 can be converted between the folded and unfolded positions in a quick and easy manner without any element of the fold mechanism 4 being temporarily removed.
2. Since the fixing member 212 is made of metal, the supporter 22 is securely coupled to the base body 211 of the base 21 to provide a stable support to the table top 3.
3. By virtue of the configuration of the supporter 22, the length of the supporter 22 can be adjusted to suit the need of the user.
4. By virtue of the design of the base body 211 of the base 21, a plurality of the folding tables can be stacked horizontally to facilitate storage.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A folding table comprising:

a support stand including a base, a supporter that extends upward from said base, and a top seat that is disposed on a top end portion of said supporter and that has a pivot portion and a first engaging portion;

a fold mechanism including a fold seat that is pivoted to said pivot portion of said top seat and that is formed with a receiving space, an operating member that is movably connected to said fold seat, and that has a second engaging portion engageable with said first engaging portion, and an abutment portion located in said receiving space, and a resilient unit that is disposed in said receiving space, and that is connected to said abutment portion of said operating member; and a table top disposed adjacent to said top seat of said support stand, connected to said fold seat, and being pivotable relative to said support stand between an unfolded position to be disposed above a top end of said support stand, and a folded position to be disposed at a lateral side of said support stand;

wherein, when said table top is at the unfolded position, said operating member is operable from a lock state, where said second engaging portion of said operating member is biased by said resilient unit to engage said first engaging portion of said top seat, to an unlock state, where said second engaging portion of said operating member is disengaged from said first engaging portion of said top seat against a resilient force of said resilient unit, thereby permitting pivot movement of said table top to the folded position, wherein said top seat of said support stand further has a seat body, said pivot portion and said first engaging portion being respectively disposed on opposite sides of said seat body, wherein said fold seat further has a slide space which spatially communicates with said receiving space and in which said second engaging portion of said operating member is located wherein said fold seat includes a main body having said receiving space and said slide space, and a stop member including a stop plate that extends into said main body to partition said receiving space and said slide space, and wherein said resilient unit is connected between said stop plate and said abutment portion of said operating member.

2. The folding table as claimed in claim 1, wherein:

said fold seat is pivoted to said pivot portion of said top seat via a pivot axle, and has a guiding groove that extends substantially parallel to said table top; and said operating member further has a connecting body portion being movable along said guiding groove, and interconnecting said abutment portion and said second engaging portion.

3. The folding table as claimed in claim 1, wherein one of said first and second engaging portions is a hook, and the other one of said first and second engaging portions is a groove.

4. The folding table as claimed in claim 1, wherein:

said fold seat further has at least one dividing member that is disposed in said receiving space and that divides said receiving space into a plurality of sub space sections;

said abutment portion of said operating member includes a plurality of abutment pieces that are respectively located in said sub space sections; and said resilient unit includes a plurality of resilient members respectively disposed in said sub space sections and respectively connected to said abutment pieces.

5. The folding table as claimed in claim 1, wherein said operating member further has a connecting body portion interconnecting said abutment portion and said second engaging portion, and an operating portion disposed on a side of said connecting body portion opposite to said abutment portion for access of a user.

6. The folding table as claimed in claim 1, wherein said supporter has a coupling end portion that is connected non-rotatably to said base.

7. The folding table as claimed in claim 1, wherein said base has a base body being substantially U-shaped, and having two leg end portions that are not parallel to each other and that cooperatively form an angle of less than 90 degrees.

8. The folding table as claimed in claim 1, wherein said supporter has an upright post, a sleeve member slidably sleeved on said upright post, and a positioning mechanism connected to said sleeve member, and disposed for positioning said sleeve member relative to said upright post.

9. The folding table as claimed in claim 8, wherein:

said upright post has an extension slot and a toothed rack portion that is disposed in said extension slot and that has a plurality of tooth grooves; and said positioning mechanism has a press member that is connected to said sleeve member, a pin that is comovably connected to said press member, and a resilient component for biasing said pin to engage one of said tooth grooves to thereby position said sleeve member relative to said upright post, said press member being pressable relative to said sleeve member against a resilient force of said resilient component to disengage said pin from the one of said tooth grooves for allowing movement of said sleeve member relative to said upright post.

10. A folding table comprising:

a support stand including a base, a supporter that extends upward from said base, and a top seat that is disposed on a top end portion of said supporter and that has a pivot portion and a first engaging portion;

a fold mechanism including a fold seat that is pivoted to said pivot portion of said top seat and that is formed with a receiving space, an operating member that is movably connected to said fold seat, and that has a second engaging portion engageable with said first engaging portion, and an abutment portion located in said receiving space, and a resilient unit that is disposed in said receiving space, and that is connected to said abutment portion of said operating member; and a table top disposed adjacent to said top seat of said support stand, connected to said fold seat, and being pivotable relative to said support stand between an unfolded position to be disposed above a top end of said support stand, and a folded position to be disposed at a lateral side of said support stand;

wherein, when said table top is at the unfolded position, said operating member is operable from a lock state, where said second engaging portion of said operating member is biased by said resilient unit to engage said first engaging portion of said top seat, to an unlock state, where said second engaging portion of said operating member is disengaged from said first engaging portion of said top seat against a resilient force of said resilient unit, thereby permitting pivot movement of said table top to the folded position, wherein said fold seat further has at least one dividing member that is disposed in said receiving space and that divides said receiving space into a plurality of sub space sections, wherein said abutment portion of said operating member includes a plurality of abutment pieces that are respectively located in said sub space sections, and wherein said resilient unit includes a plurality of resilient members respectively disposed in said sub space sections and respectively connected to said abutment pieces.

11. The folding table as claimed in claim 10, wherein said top seat of said support stand further has a seat body, said pivot portion and said first engaging portion being respectively disposed on opposite sides of said seat body.

12. The folding table as claimed in claim 11, wherein:

said fold seat is pivoted to said pivot portion of said top seat via a pivot axle, and has a guiding groove that extends substantially parallel to said table top; and said operating member further has a connecting body portion being movable along said guiding groove, and interconnecting said abutment portion and said second engaging portion.

13. The folding table as claimed in claim 11, wherein said fold seat further has a slide space which spatially communicates with said receiving space and in which said second engaging portion of said operating member is located.

14. The folding table as claimed in claim 13, wherein:

said fold seat includes a main body having said receiving space and said slide space, and a stop member including a stop plate that extends into said main body to partition said receiving space and said slide space; and said resilient unit is connected between said stop plate and said abutment portion of said operating member.

15. The folding table as claimed in claim 10, wherein one of said first and second engaging portions is a hook, and the other one of said first and second engaging portions is a groove.

16. The folding table as claimed in claim 10, wherein said operating member further has a connecting body portion interconnecting said abutment portion and said second engaging portion, and an operating portion disposed on a side of said connecting body portion opposite to said abutment portion for access of a user.

17. The folding table as claimed in claim 10, wherein said supporter has a coupling end portion that is connected non-rotatably to said base.

18. The folding table as claimed in claim 10, wherein said base has a base body being substantially U-shaped, and having two leg end portions that are not parallel to each other and that cooperatively form an angle of less than 90 degrees.

19. The folding table as claimed in claim 10, wherein said supporter has an upright post, a sleeve member slidably sleeved on said upright post, and a positioning mechanism connected to said sleeve member, and disposed for positioning said sleeve member relative to said upright post.

20. The folding table as claimed in claim 19, wherein:

said upright post has an extension slot and a toothed rack portion that is disposed in said extension slot and that has a plurality of tooth grooves; and said positioning mechanism has a press member that is connected to said sleeve member, a pin that is comovably connected to said press member, and a resilient component for biasing said pin to engage one of said tooth grooves to thereby position said sleeve member relative to said upright post, said press member being pressable relative to said sleeve member against a resilient force of said resilient component to disengage said pin from the one of said tooth grooves for allowing movement of said sleeve member relative to said upright post.

* * * * *